United States Patent [19]

Hummel

[11] 3,977,349

[45] Aug. 31, 1976

[54] BOAT POSITIONING DEVICE

[76] Inventor: Max Hummel, 164-02 95th St., Howard Beach, N.Y. 11414

[22] Filed: July 9, 1975

[21] Appl. No.: 594,529

Related U.S. Application Data

[63] Continuation-in-part of Ser. No. 527,747, Nov. 27, 1974, abandoned.

[52] U.S. Cl. ..... 114/66.5 P
[51] Int. Cl.[2] ..... B63B 1/22
[58] Field of Search ..... 114/66.5 P

[56] References Cited

UNITED STATES PATENTS

| | | | |
|---|---|---|---|
| 2,265,206 | 12/1941 | Stampfl | 114/66.5 P |
| 3,298,344 | 1/1967 | Yunker et al. | 114/66.5 P |
| 3,413,948 | 12/1968 | Coll | 114/66.5 P |
| 3,496,899 | 2/1970 | Weber | 114/66.5 P |
| 3,589,323 | 6/1971 | Kercheval | 114/66.5 P |
| 3,604,383 | 9/1971 | Ingelman-Sundberg | 114/66.5 P |

*Primary Examiner*—Trygve M. Blix
*Assistant Examiner*—Stuart M. Goldstein
*Attorney, Agent, or Firm*—Ernest G. Montague

[57] ABSTRACT

A boat is equipped with a positioning device for adjusting its depth position in response to the load of the boat and a pressure space such as a flexible bag is disposed between oppositely arranged trim tabs, the position of the trim tabs being controlled by the pressure in the pressure space, so that by change of the pressure the positioning of the boat in the water is changed accordingly in response to the load of the boat.

1 Claim, 4 Drawing Figures

BOAT POSITIONING DEVICE

This is a Continuation-in-Part application of the copending patent application Ser. No. 527,747, filed Nov. 27, 1974 and now abandoned.

The present invention is concerned with water-going vessels such as boats and relates to a device intended to influence the attitude or course of the vessel in the water by means of a control surface such as a trim surface which coacts with the bypassing water while generating control forces exerted on the vessel.

It is one object of the present invention to provide a boat positioning device which includes means for adjusting the depth of the boat responsive to the load of the boat.

It is another object of the present invention to provide means for adjusting the depth of the boat in response to the load of the boat which comprises at least one bottom trim tab or two trim tabs in parallel arrangement and provided at the bottom of the boat, an upper trim tab being affixed to the bottom face of the boat, while a lower trim tab is hingedly connected to the upper trim tab.

It is still another object of the present invention to provide a boat positioning device which includes resilient means for maintaining the bottom tab in its lowermost position when the load present on the boat is not very great.

It is still a further object of the present invention to provide a boat positioning device which includes a preferably plastic bulb or bag, to form a pressure space, which is preferably disposed between the upper trim tab and the lower trim tab or between the bottom of the boat and the lower trim tab and is inflated with a gaseous or a liquid fluid, such as air or water to force the bottom trim tab downwardly, as the pressure in the pressure space is to be increased.

It is yet another object of the present invention to provide a boat positioning device wherein either a through hull fitting extends through the bottom of the boat for each set of the tabs or a fitting is provided preferably adjacent the stern side of the hull of the boat.

With these and other objects in view, which will become apparent in the following detailed description, which is shown by example only, the present invention is clearly disclosed in the accompanying drawings, in which.

Figure 1:
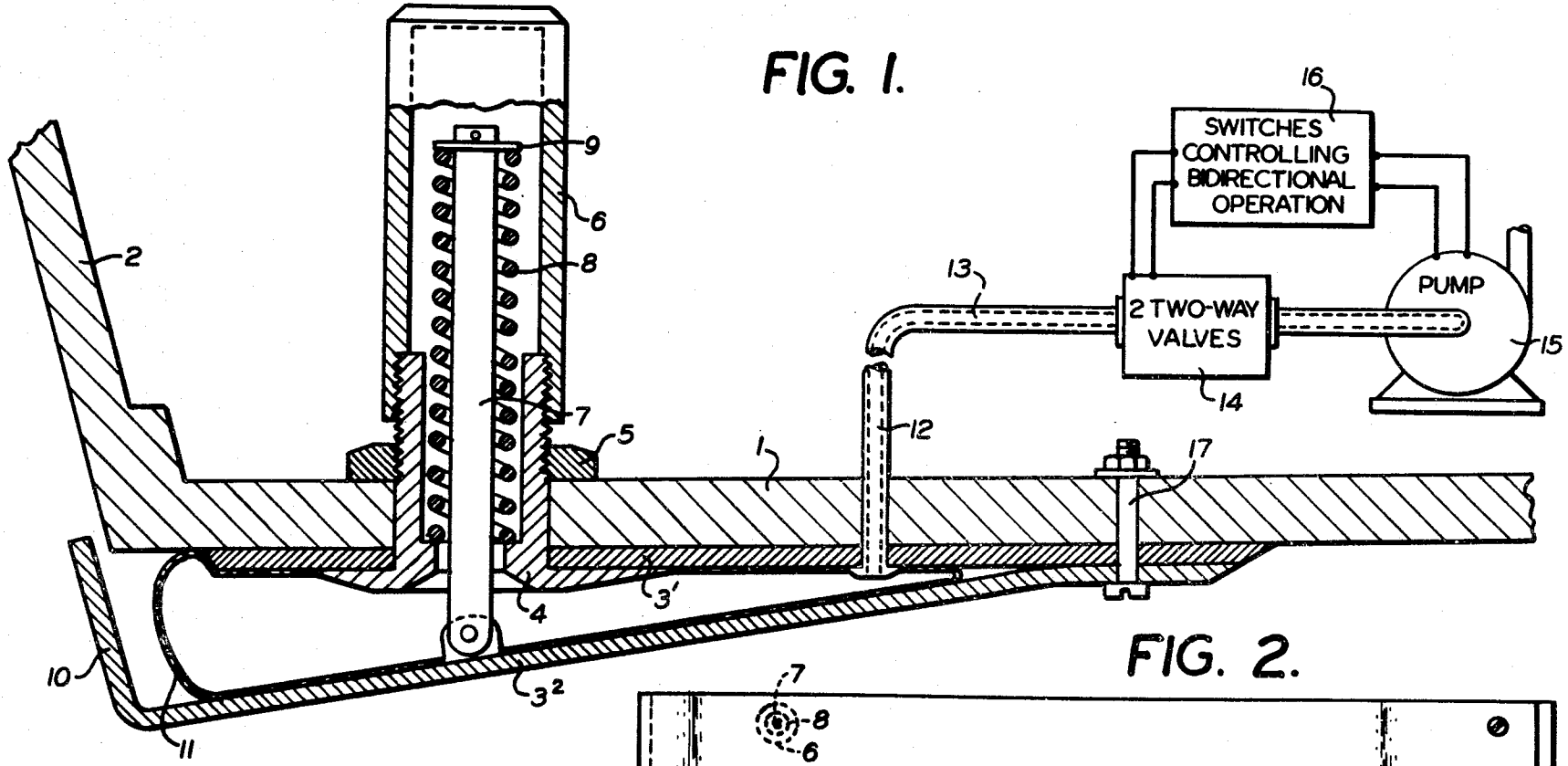
FIG. 1 is a vertical section of a fragmentary portion of a boat disclosing a lower and an upper tab.
Figure 2:
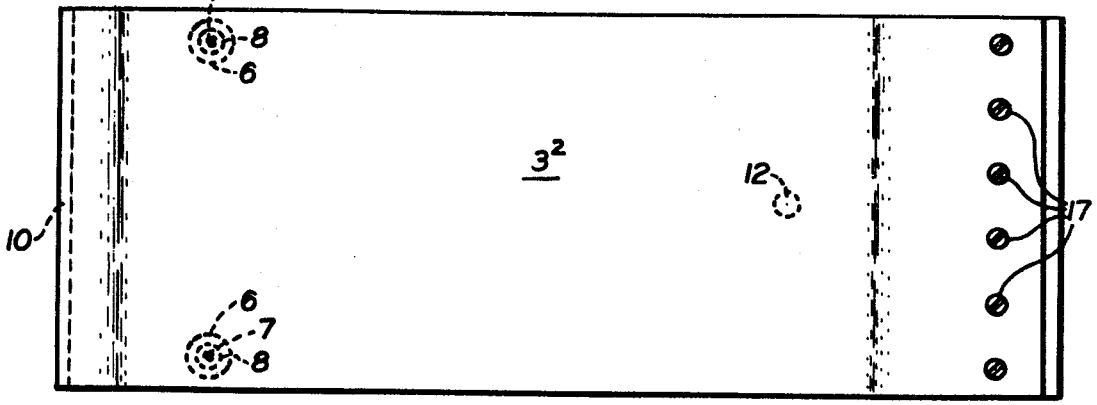
FIG. 2 is a bottom plan view of the bottom tab.

Referring now to the drawing and in particular to FIGS. 1 and 2, a boat, a bottom portion 1 of which is shown in FIG. 1, has a stern side 2. Two trim tabs are arranged, thereby providing an upper tab 3' and a lower tab $3^2$. For each set of tabs a through hull fitting 4 extends through the bottom 1 of the boat, which fitting is secured to the latter by means of an appropriate nut 5. A cover 6 is secured to the outer periphery of the through hull fitting 4 to enclose a rod 7 and preferably also a tubing (not shown).

A helical spring 8 surrounds the rod 7 and engages at its bottom a ring face of the fitting 4 and at its top an abutment plate 9, the latter being properly secured to the rod 7. The bottom of the rod 7 is preferably pivotally mounted on the lower tab $3^2$ and the forward end of the tab $3^2$ has an upwardly bent portion 10 to terminate close to the stern end 2 of the bottom 1 of the boat.

A bag or flexible bulb 11 is disposed between the upper tab 3' and the lower tab $3^2$ and a filling tube 12 leads through the bottom 1 of the boat to the pressure space of the bag or bulb for the purpose to feed air, or any liquid or gaseous fluid into the bulb 11 and to create an increase or decrease, respectively, of the inner pressure of the bag or bulb 11. Upon increase of the pressure inside of the bulb the helical spring 8 will either be compressed or extended depending upon the weight or the load bearing on the boat thereby changing the position of the bottom of the boat relative to the surrounding water.

The filling tube 12 leads through a conduit 13 to a housing 14 containing two two-way valves which are in operative connection with a manual or electrical pump 15 by means of switches 16 controlling the bidirectional operation.

The lower tab $3^2$ is connected with the upper tab 3' as well as with the bottom 1 of the boat by means of a plurality of bolts 17 to bring about a hinge effect between the upper and the lower tabs in order to increase or decrease the pressure in the pressure space depending upon requirements.

Figure 3:
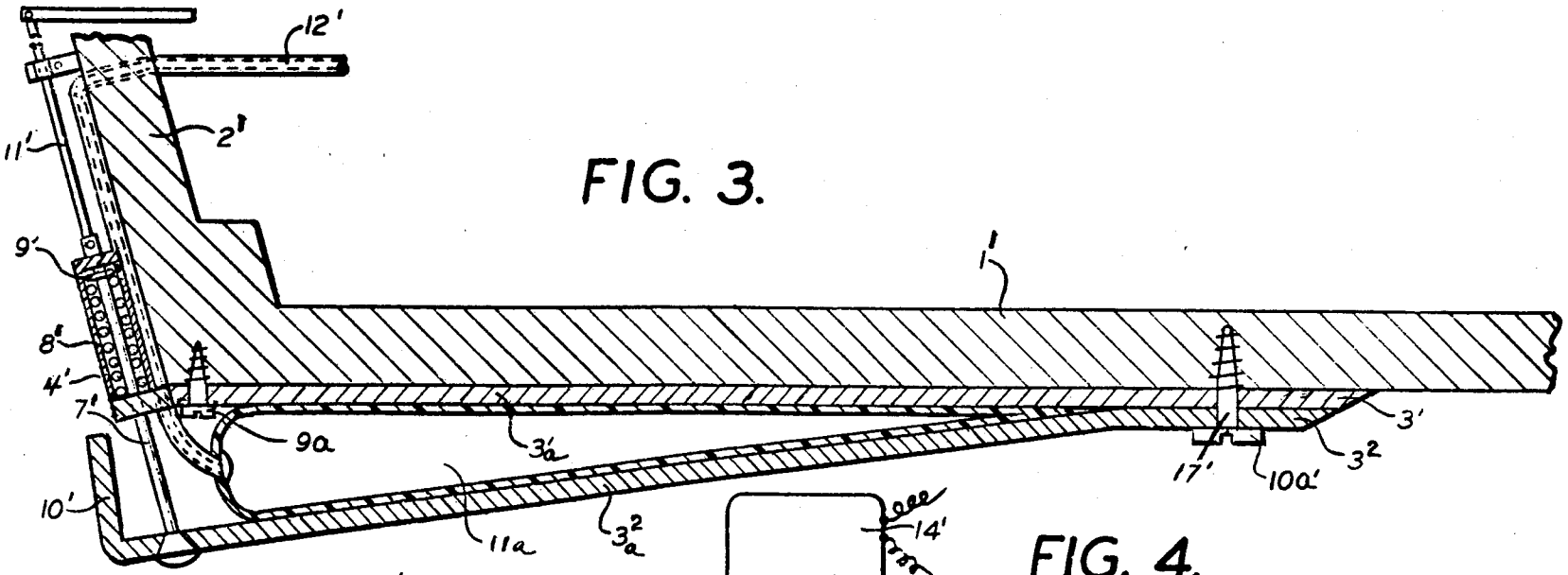
FIG. 3 is a vertical section of a fragmentary portion of a boat disclosing a lower and an upper tab in connection with another embodiment of the present invention.
Figure 4:
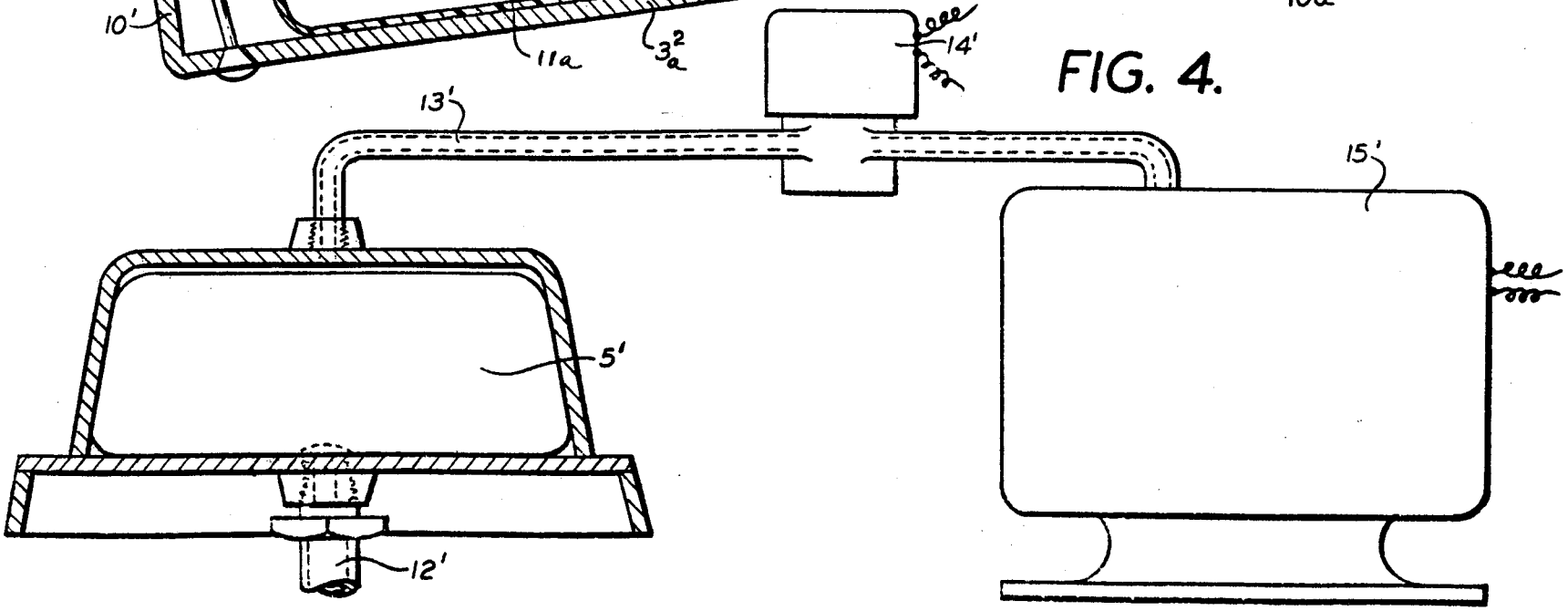
FIG. 4 is a schematic showing of the compression chamber in operative connection with the compressor controlled by solenoid valves.

Referring now again to the drawings and in particular to FIGS. 3 and 4, a boat, a bottom portion 1' of which is shown in FIG. 3, has a stern side 2'. This embodiment is substantially identical with the embodiment disclosed in FIGS. 1 and 2 with the exception that the through hull fitting 4 as shown in FIG. 1 of the drawings is replaced by a fitting disposed outside the hull of the boat preferably adjacent the stern side 2' thereof. Accordingly, at least a bottom trim tab or two trim tabs, namely an upper trim tab and a lower trim tab are arranged also in the second embodiment of the present invention, thereby providing an upper tab 3a' and a lower tab $3a^2$. Said trim tabs 3a' and $3a^2$ are secured to the boat hull by means of screws 9a' and 10a'. A cover 4' is secured to the fitting to enclose a rod 7'.

A helical spring 8' surrounds the rod 7' and engages at its bottom a ring face of the fitting and at its top an abutment plate 9', the latter being properly secured to the rod 7'. The bottom of the rod 7' is preferably pivotally mounted on the lower tab $3a^2$ and the forward end of the tab $3a^2$ has an upwardly bent portion 10' to terminate close to the stern end 2' of the bottom 1' of the boat.

As in the previously described embodiment a bag or flexible bulb 11a is disposed between the upper tab 3a' and the lower tab $3a^2$ and a filling tube 12' leads through the stern side of the boat and enters the pressure space of the bag or bulb 11a for the purpose to feed air, or any liquid or gaseous fluid into the bulb 11a and to create an increase or decrease, respectively, of the inner pressure of the bag or bulb 11a. Upon increase of the pressure inside the bulb 11a the helical spring will either be compressed or extended depending upon the weight of the load bearing on the boat, thereby changing the position of the bottom of the boat relative to the surrounding water.

As in the previous embodiment, the filling tube 12' leads through a conduit 13' to a housing 14' containing two two-way valves and from there to a compressor 15' controlling the bidirectional operation.

As indicated in connection with FIG. 2 of the first embodiment, the second embodiment likewise connects the lower tab $3a^2$ with the upper tab $3a'$ or with the bottom 1' of the boat by means of a plurality of bolts 17' to bring about a hinge effect between the upper and lower tabs in order to decrease the pressure in the pressure space depending upon the requirements. In the second embodiment a pressure chamber 5' is provided between the filling tube 12' and the conduit 13'.

The boat positioning device which is designed for the adjustment of the depth position of the boat in response to its load is operated in the following manner:

As indicated above the housing 14' includes two two-way valves depending upon the desire of increasing or decreasing the pressure in the pressure space. For this purpose the switches 16 control a bidirectional operation in order to control the direction of the flow of the fluid into or out of the pressure space or of the bulb, respectively. The pressure inside the pressure space will always balance out with the pressure created by the helical spring 8' and will accordingly change the position of the lower tab $3^2$ and thereby the position of the boat in the water.

While I have disclosed two embodiments of the present invention, it is to be understood that these embodiments are given by example only and not in a limiting sense.

I claim:

1. A boat comprising a hull with a stern and a bottom, at least a lower trim tab pivotally secured to said hull, to provide a hinge connection between said lower trim and said hull, expansible chamber means disposed above said lower trim tab, a fitting secured to said hull of the boat, a rod pivotally secured to said lower trim tab and a helical spring surrounding said rod and countering the pressure present in said expansible chamber means, a filler tube extending through said hull into said expansible chamber means adapted to increase and decrease, respectively, the pressure in said expansible chamber means, a pump connected with said filler tube for feeding and releasing, respectively, fluid into said expansible chamber means, said expansible chamber means comprising a flexible bag, a conduit leading said filler tube into a housing, two two-way valves disposed in said housing, said two two-way valves being in operative connection with a pump, and switches controlling the bidirectional operation of said pump.

* * * * *